US006238545B1

(12) United States Patent
Allebach et al.

(10) Patent No.: US 6,238,545 B1
(45) Date of Patent: May 29, 2001

(54) COMPOSITE ANODE, ELECTROLYTE PIPE SECTION, AND METHOD OF MAKING AND FORMING A PIPELINE, AND APPLYING CATHODIC PROTECTION TO THE PIPELINE

(76) Inventors: Carl I. Allebach, 825 Clemens Rd., Telford, PA (US) 18969; Albert A. Smith, 1715 Kramer Mill Rd., Denver, PA (US) 17517; Walter T. Young, 242 N. Rolling Rd., Springfield, PA (US) 19064

( * ) Notice: Subject to any disclaimer, the term of this patent is extended or adjusted under 35 U.S.C. 154(b) by 0 days.

(21) Appl. No.: 09/365,500

(22) Filed: Aug. 2, 1999

(51) Int. Cl.[7] ..... C23F 13/00

(52) U.S. Cl. ..... 205/734; 205/730; 205/740; 204/196.15; 204/196.16; 204/196.19; 204/196.2; 204/196.33; 204/196.37; 427/105; 427/424; 427/425; 427/427; 264/8; 264/13; 264/540; 264/542; 264/563; 264/173; 264/177.14; 264/209.1; 264/212; 264/228; 264/249; 264/309; 264/310; 156/429

(58) Field of Search ..... 205/730, 734, 205/740; 204/196.15, 196.16, 196.19, 196.2, 196.33, 196.34, 196.37; 427/105, 424, 425, 427; 264/8, 13, 86, 87, 540, 542, 563, 171, 173, 176.1, 177.1, 177.14, 209.1, 212, 228, 249, 309, 310; 156/429

(56) References Cited

U.S. PATENT DOCUMENTS

D. 206,605 1/1967 Versoy et al. .
D. 219,218 11/1970 Eisele .
D. 223,665 5/1972 Eisele .
D. 223,666 5/1972 Eisele .
2,491,225 12/1949 Stearns .
2,594,000 4/1952 Elliott .

(List continued on next page.)

FOREIGN PATENT DOCUMENTS

WO 88/08462 11/1988 (WO) .

* cited by examiner

*Primary Examiner*—Bruce F. Bell
(74) *Attorney, Agent, or Firm*—Renner, Otto, Boisselle & Sklar, LLP

(57) ABSTRACT

An anode is embedded in an electrolyte layer applied to the surface of a structure such as a pipe section to provide an ionic conductive path between the anode and structure to supply cathodic protection to the structure, where the natural environment may not provide a continuous electrolyte. The anode is comprised of a material normally used as a cathodic protection anode material, such as, an expanded valve metal mesh or ribbon having either an electrochemically active coating or noble metal coating, or a sacrificial anode metal alloy. The anode material is made continuous from one end of the structure to the other and may be connected to a common bus wire from one end to the other. The anode and structure to be protected are connected using wires to a DC power supply that causes cathodic protection current flow to the structure in the case of an impressed current system. No separate power supply is needed in the case of a galvanic or sacrificial anode system. A pipeline is formed from a series of interconnected composite pipe sections.

41 Claims, 3 Drawing Sheets

U.S. PATENT DOCUMENTS

| | | | | |
|---|---|---|---|---|
| 2,602,980 | | 7/1952 | Bryan . | |
| 3,260,661 | | 7/1966 | Kemp et al. . | |
| 3,343,081 | | 9/1967 | Lane . | |
| 3,349,017 | | 10/1967 | Ziegler . | |
| 3,354,063 | | 11/1967 | Shutt . | |
| 3,581,922 | | 6/1971 | Versoy et al. . | |
| 3,614,605 | | 10/1971 | Eisele . | |
| 3,661,624 | | 5/1972 | Versoy et al. . | |
| 3,674,546 | | 7/1972 | Harris et al. . | |
| 3,700,223 | | 10/1972 | Elliott . | |
| 3,718,309 | | 2/1973 | Harris . | |
| 3,743,470 | | 7/1973 | Bickham . | |
| 3,747,192 | | 7/1973 | Harris et al. . | |
| 3,777,705 | | 12/1973 | Harris et al. . | |
| 3,784,349 | | 1/1974 | Bickham . | |
| 3,807,588 | | 4/1974 | Bickham . | |
| 3,894,637 | | 7/1975 | Bickham . | |
| 3,924,562 | | 12/1975 | Harris et al. . | |
| 3,937,382 | | 2/1976 | Cunningham et al. | 228/49 |
| 3,985,848 | | 10/1976 | Frische et al. | 264/88 |
| 4,004,619 | | 1/1977 | Eddlemon et al. | 141/11 |
| 4,006,049 | | 2/1977 | Gardner | 156/195 |
| 4,051,436 | * | 9/1977 | Weir, Jr. | 204/196.15 |
| 4,058,428 | | 11/1977 | Case et al. | 156/429 |
| 4,073,760 | | 2/1978 | Harris et al. | 260/28.5 |
| 4,091,291 | * | 5/1978 | Foster et al. | 204/196.2 |
| 4,096,017 | | 6/1978 | Wyke et al. | 156/275 |
| 4,126,718 | | 11/1978 | Christie et al. | 427/286 |
| 4,141,130 | | 2/1979 | Hart et al. | 29/407 |
| 4,160,329 | | 7/1979 | Scrimshaw | 33/178 D |
| 4,205,544 | | 6/1980 | Foster | 73/307 |
| 4,205,774 | | 6/1980 | Madden et al. | 228/32 |
| 4,213,357 | | 7/1980 | Lively et al. | 82/4 C |
| 4,244,740 | | 1/1981 | Harris | 106/14.34 |
| 4,249,477 | | 2/1981 | Christie et al. | 118/413 |
| 4,267,029 | | 5/1981 | Massarsky | 204/196 |
| 4,284,385 | | 8/1981 | Lively et al. | 414/747 |
| 4,333,783 | | 6/1982 | Gardner | 156/187 |
| 4,366,972 | | 1/1983 | Franklin | 285/55 |
| 4,506,485 | * | 3/1985 | Apostolos | 204/196.37 |
| 4,591,792 | | 5/1986 | Birchmeier et al. | 324/425 |
| 4,623,435 | * | 11/1986 | Nebgen et al. | 204/196.15 |
| 4,670,301 | | 6/1987 | Jaremco et al. | 427/195 |
| 4,826,577 | * | 5/1989 | Lange | 205/734 |
| 4,900,410 | | 2/1990 | Bennett et al. | 204/196 |
| 5,174,871 | * | 12/1992 | Russell | 205/734 |
| 5,290,407 | | 3/1994 | Syrett et al. | 204/196 |
| 5,292,411 | * | 3/1994 | Bartholomew et al. | 205/734 |
| 5,639,358 | | 6/1997 | Bennett et al. | 204/196 |
| 5,667,623 | | 9/1997 | Hanson | 156/367 |
| 5,814,982 | | 9/1998 | Thompson et al. | 324/71.1 |

COMPOSITE ANODE, ELECTROLYTE PIPE SECTION, AND METHOD OF MAKING AND FORMING A PIPELINE, AND APPLYING CATHODIC PROTECTION TO THE PIPELINE

DISCLOSURE

This invention relates to cathodic protection of metal structures such as pipelines, a composite anode-electrolyte pipe section, and methods of making such pipe sections, as well as forming the pipeline, and applying cathodic protection to the pipeline.

BACKGROUND OF THE INVENTION

Cathodic protection is defined as either (1) the reduction of corrosion rate by shifting the corrosion potential of the electrode toward a less oxidizing potential by applying an external electromotive force or (2) the partial or complete protection of a metal from corrosion by making it a cathode, using either a galvanic or impressed current. Cathodic protection is well established method by which a metal can be protected from corrosion. It is used anywhere the structure and anode are embedded in a common electrolyte, such as, on pipelines, tanks, piers, pilings, bridge decks and substructures.

Cathodic protection is accomplished by causing a flow of direct current (DC) between another electrode (called the anode) and the structure (called the cathode). The DC causes the surface of the structure to become polarized, thus stopping or reducing corrosion.

In an impressed current cathodic protection system, a rectifier normally converts AC to DC and supplies the current; and the anode is a relatively inert material that can transfer the current to the soil or water, which is the normal electrolyte. In a galvanic system, the anode is an electrochemically active metal compared to the cathode, and the current is a natural occurrence of connecting the anode and cathode together.

The chemical reaction at the anode is metal oxidation, with oxygen, or chlorine evolution. Both ions and electrons are formed at the anode. Ions generated by the reaction flow to the cathode via the electrolyte. The electrons flow to the cathode via a connection. Reduction occurs at the cathode, which consumes the electrons. Three common cathodic reactions in cathodic protection are as follows:

$$O_2+2H_2O+4e\rightarrow 4OH^-$$

$$O_2+4H^++4e\rightarrow 2H_2O$$

$$2H^++2e\rightarrow H_2$$

In all cases, both electron and ionic currents are involved in cathodic protection. That is, both a continuous common electrolyte and a metallic connection between the anode and cathode are required. The metallic connection is provided through the rectifier. The soil, water, or other conductive medium provides the common electrolyte.

In cathodic protection practice, anodes may be installed in the ground or water where the anodic reactions take place. Anodes can be installed in several different configurations depending on the requirements; these include (1) a single point using shallow anodes, (2) evenly spaced along the structure (distribution system), or (3) in a deep well. Common anode materials include pure metals, alloyed metals, platinum coated valve metals, valve metals having electrochemically active coatings, and certain ceramic materials.

If a separation or void in the electrolyte occurs between the anode and cathode, the current will stop, and cathodic protection will fail. Conditions where the electrolyte becomes discontinuous between anode and cathode can and do occur in practice. Examples of situations where this could occur include: coarse backfill materials that are too coarse to permit intimate or uniform contact with the structure surface (e.g., gravel, rocks); where fine backfill is washed away from the environment surrounding the structure from groundwater flow leaving voids against the structure containing only air; and in exposed situations where fine backfill is not possible or practical to place.

The application of anode material embedded in concrete for the cathodic protection of steel reinforcement in concrete bridge decks and substructures, piers, and buildings is common. The use of an anode embedded in an acidresistant cement liner containing an anode for the cathodic protection of stainless steel flue gas ducts is disclosed in U.S. Pat. No. 5,290,407. This patent applies to the protection of stainless steel flue gas ducts that are exposed to an environment consisting of a thin-film acidic condensate in an otherwise atmospheric environment. There is a significant problem in providing proper cathodic protection with respect to buried steel structures such as pipelines, where the natural environment consists of rocks or other materials that present voids or prevent full contact between the structure and environment.

SUMMARY OF THE INVENTION

The principal aspect of the invention is the use of an anode material embedded in a conductive layer that has been applied to the surface of a metallic structure such that the anode and conductive layer and structure form a composite, and from which a self-contained cathodic protection system can be constructed. The invention is pre-applied to the structure, and the anode, electrolyte, and structure are installed as a composite. The use of a concrete coating on the structure or pipe also serves as an anti-buoyancy mass to keep the structure or pipe from floating, and further serves as a protective casing.

The cathodic protection system of the present has the following advantages:

1. A continuous backfill surrounding the structure is not necessary since the conductive layer, anode, structure, and power supply (if used) form a self-contained cathodic protection system; therefore, cathodic protection can be applied to structures in environments where a continuous surrounding electrolyte is difficult, expensive, or impossible to achieve.

2. The anode provides a continuous distributed current source that provides an even current distribution to the structure.

3. A separate anode bed is not necessary since the anode and electrolyte are integrated with the structure.

4. Cathodic protection is then possible in areas where the right-of-way is too narrow to use conventional anodes, such as the single point, distribution systems, or deep well systems noted above.

It is also an aspect of the invention to provide a process for constructing a cathodic protection system with the structure itself, as well as a process for forming a composite section of the structure which includes the structure section, the anode and the electrolyte.

To the accomplishment of the foregoing and related ends, the invention then comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
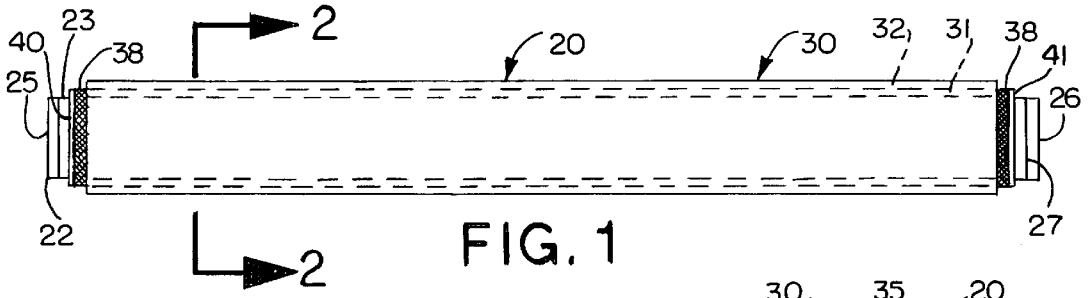
FIG. 1 is a side elevation of a composite structure or pipe section in accordance with the present invention incorporating a mesh anode in an electrolyte coating.
Figure 2:
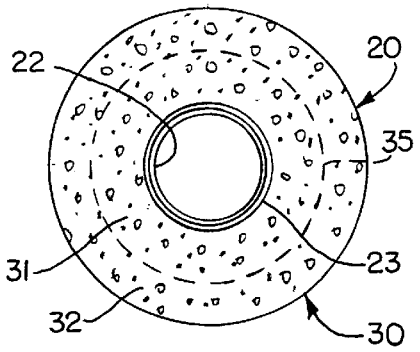
FIG. 2 is a transverse section of the pipe section of FIG. 1 taken substantially from the line 2—2 of FIG. 1.
Figure 3:
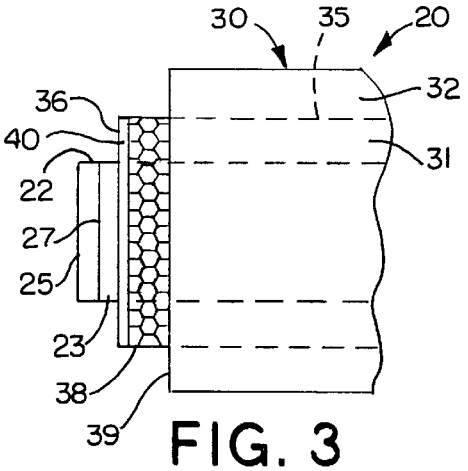
FIG. 3 is an enlarged broken side elevation of one end of the pipe section of FIG. 1.

Referring initially to FIGS. 1, 2, and 3 there is illustrated a composite pipe section in accordance with the present invention shown generally at 20. The composite pipe section includes an inner metal pipe such as a conventional steel pipe 22 with a relatively thin dielectric coating 23. Such steel pipe sections may conventionally be approximately 40 feet in length, and they vary in diameter from a few inches or centimeters to more than a yard or meter. As indicated, at each end of the composite pipe section 20 the metal pipe is exposed as seen at 25 and 26 with the dielectric coating stopping at 27 to expose the ends 25 and 26. The ends of the pipe sections are normally beveled to permit and facilitate groove/buttweld joining. Other types of pipe sections may be employed such as bell and spigot connections. The basic metal pipe may be seam welded or spiral welded pipe sections cut to length, and treated or beveled at the cut ends. The dielectric coating may be in the form of a wrapping or mastic material.

The outer coating, shown generally at 30, comprises two concentric sections in the form of an inner section 31 and an outer section 32. In reality the two sections are a continuum of each other and fully embed the major extent of a mesh anode shown generally at 35 which radially separates the two sections. The mesh anode is concentric with the concrete sections and the pipe. The two sections of concrete in the illustration may be of substantially the same radial extent and the only difference between the inner and outer sections is the size and circumference. The inner section normally extends axially the same extent as the outer section at the mesh anode. The anode however extends further than the ends of the concrete sections to the point 36 which exposes the end of the mesh anode to a short extent as indicated at 38. The sections of concrete thus normally stop at 39 to expose the anode ends. To complete the composite anode-pipe section bus rings 40 and 41 are spot welded to the projecting ends of the anode mesh at several points around the circumference. The projecting end of the anode is exposed on both radial sides to facilitate attachment of the bus rings.

Although the dimensions of the pipe such as its diameter and wall thickness may vary substantially, there are certain minimal dimensions which are considered somewhat important. For example, radial thickness of the inner section of the concrete continuum between the outer part of the pipe and the anode should be approximately at least ¾ of an inch or about 18 to 20 millimeters. Also the axially length of the projecting portion of the mesh anode should be approximately 2 inches or about 5 to 6 centimeters, while the width of the bus bar ring at the outer edge of the anode may be approximately a ½ inch or 1.25 centimeters. For some applications, the outer concrete section 32 may be substantially thicker or heavier.

The dimensions may thus vary widely depending upon the applications for the pipe section. The concrete coating sections may be formed with a conventional mixture of sand and Portland cement to form a sprayable, castable or extrudable mixture as hereafter described. The anode material is preferably in the form of a coated valve metal. The mesh is a highly expanded valve metal which has multiple current paths, nodes, and enhanced redundancy. The valve metal is preferably titanium with a mixed metal oxide or noble metal passivating coating. The bus rings at each end are preferably conductor rings or bars of the same valve metal with a similar coating. Such valve metal mesh comes in large sheets or rolls and can easily be applied to the concrete coating to be embedded in the concrete sections substantially concentric with the pipe axis. The mesh anode which is dimensionally stable is the preferred form of anode for an impressed current cathodic protection system for the pipeline to be constructed with the pipe sections seen in FIGS. 1 through 3. For a more detailed disclosure of such mesh anode material reference may be had to Bennett et al. U.S. Pat. Nos. 4,900,410 or 5,639,358, for example.

Figure 4:
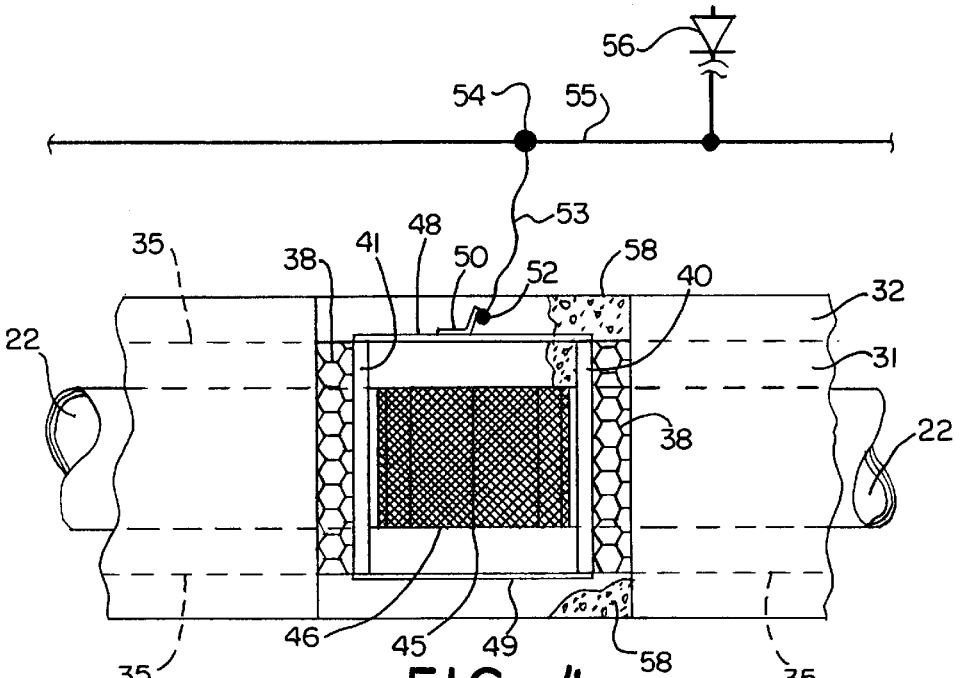
FIG. 4 is a side elevation of a pipe section joint showing the anodes of adjacent sections electrically connected, and electrically connected to a parallel bus wire.

Referring now to FIG. 4 there is illustrated a joint of two composite pipe sections in accordance with the present invention. The exposed metal ends of the two pipe sections are butt welded as indicated at 45. The pipe sections are then covered with a joint coating seen at 46 which may be a continuation of the coating 23 for each pipe section. With the two pipe sections now joined end-to-end, the bus rings 40 and 41 are joined by shorting bars 48 and 49. Preferably there are at least two such shorting bars on opposite sides of the connection. They are preferably tack welded to the outer surface of the bus rings as illustrated. The shorting bar 48 near the top of the joint is provided with a spot welded connector or lug 50 which projects upwardly from the shorting bar 48, and to which is welded at 52 a transition 53 also connected at 54 to a bus line or wire 55. Other molecular bonds may be employed. Cathodic protection power may be supplied to the bus line 55 by power supplies such as rectifiers 56 above ground and spaced periodically along the pipe line. The shorting bars 48 and 49, although shown as two in number, may include redundant additional bars spaced symmetrically around the bus rings. Both the connector or lug 50 as well as the transition 53 are preferably of the same valve metal as the mesh anodes. It will be appreciated that not every pipe joint need be provided with the connection to the bus as long as the anodes of adjacent pipe sections are properly electrically connected, yet spaced from the metal of the pipe. After the pipe connection has been formed as seen in FIG. 4, the void between the concrete coatings of the two pipe sections is then filled with concrete as indicated at 58.

Figure 5:
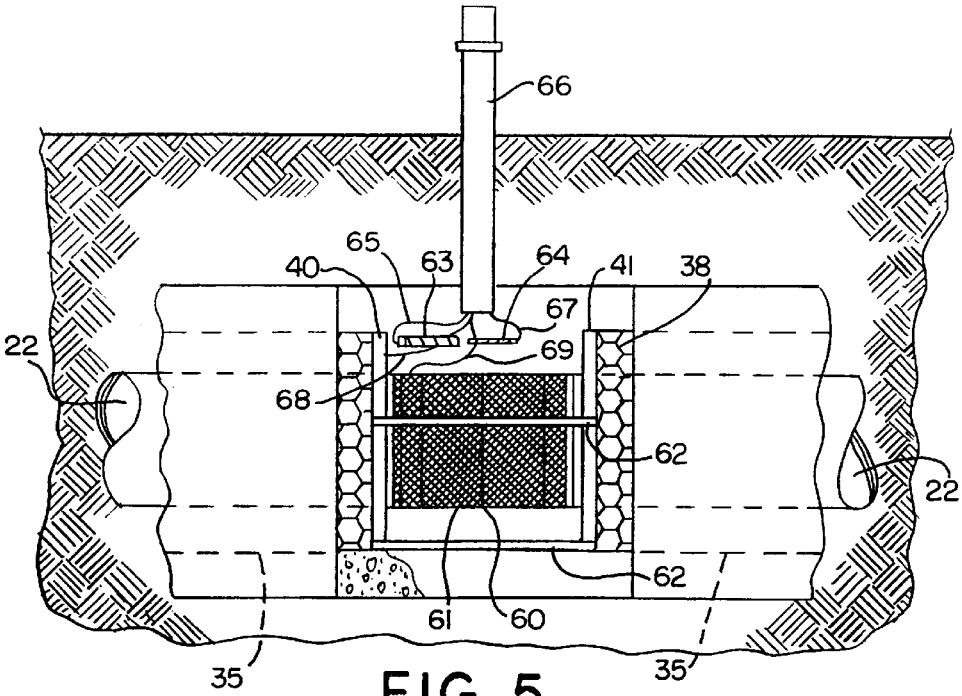
FIG. 5 illustrates a joint like that of FIG. 4 but incorporating a test station, reference electrodes, and a resistance or polarization probe or coupon.

Referring now to FIG. 5 there is illustrated a joint like that of FIG. 4 but incorporating a monitoring system at a test station. The joint is formed in substantially the same manner as FIG. 4 with a buttweld at 60 and a continuation of the dielectric wrapping or coating over the joint as illustrated at 61. The shorting bars indicated at 62 may extend from bus ring to bus ring across the joint. There may be a sufficient number of shorting bars to insure redundancy, but there is not a shorting bar at the top of the joint. This allows room for the positioning of a reference electrode as indicated at 63, and a resistance-polarization probe or coupon indicated at 64. The reference electrode is connected through conductor 65 to a contact or connection at the top of test station 66 which is embedded in the ground to project upwardly above ground. The resistance- polarization probe or coupon 64 is also connected to the proper contact at the top of the test station by conductor 67. The test station also includes connections from the proper probes or poles to the anode as seen at 68 and also to the pipe as seen at 69. The latter may be made before the joint is completed.

After the connections are made and tested, the bottom of the test station may be embedded approximately 2 inches (5 centimeters) into the concrete which is cast around the joint. After the concrete hardens, the test station will be supported in its upright position as shown to project above the surface of the ground. In this manner test stations may be provided periodically along the pipeline. These test stations enable the owner to monitor the effectiveness of the cathodic protections system.

The reference electrode may be a conventional copper-copper sulfate, or silver-silver chloride reference cell, while the probe or coupon may be of the same metal or alloy as the pipe. Resistance measurements on the probe or coupon over time are an indication of the corrosion of the coupon or probe, and thus an analog measurement of the effectiveness of the system.

Figure 7:
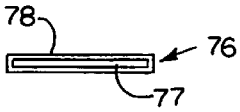
FIG. 7 is an enlarged transverse section of a suitable ribbon showing its passivating coating.
Figure 6:
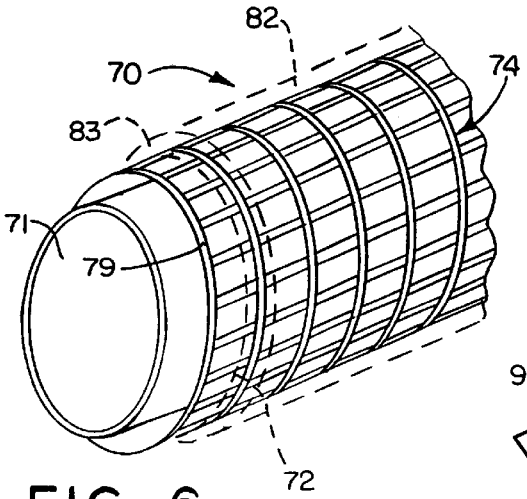
FIG. 6 is a fragmentary perspective view of a composite section embodiment of the present invention utilizing metal ribbons as the electrolyte embedded anode.

Referring now to FIG. 6 it will be seen that there is illustrated a composite pipe section shown generally at 70 which comprises the metal inner pipe 71 which extends axially beyond an inner section of electrolyte shown generally at 72 which separates a concentric grid anode shown generally at 74 from the exterior of the metal pipe. The anode 74 is formed as a reticulate grid of valve metal ribbons such as seen at 76 in FIG. 7. The ribbon 76 may have a valve metal core 77 such as titanium, and an exterior mixed metal oxide or noble metal coating 78. Reference may be had to the noted Bennett et al. patents for further details of the valve metals together with the various coatings. The grid anode projects beyond the end of the inner section of the electrolyte 72 and at each exposed end there is provided an annular bus ring 79. The concrete sections embed the grid anode in a continuum of the electrolyte spaced from the metal pipe. The outer section of the electrolyte 82 forms with the inner section the end face noted at 83 exposing the end of the grid anode at each end of the pipe section.

The composite pipe section illustrated in FIG. 6 also includes the dielectric coating, not shown, and the pipe sections are assembled to form the pipeline and the grid anodes interconnected as in FIGS. 4 and 5.

Figure 8:
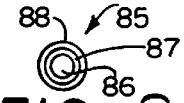
FIG. 8 is a transverse section of a wire which may be used to form a similar grid anode.

The grid anode may also be formed of round section wire shown somewhat enlarged in FIG. 8 at 85. The wire may include a copper core 86, a valve metal or titanium sheath 87, and an outer mixed metal oxide or noble metal passivating coating 88. A grid may be formed of such wire by tack or spot welding techniques, and then the grid coiled to form a cylinder to be embedded in the inner and outer sections of electrolyte as in FIG. 6.

The embodiments of FIGS. 1–8 represent composite pipe sections and pipe lines for impressed current cathodic protections systems. In each instance the anode is spaced from the metal pipe and the ionic flow through the electrolyte is created by an external power source such as the rectifier. The other major type of cathodic protection is that of sacrificial anodes where the current flow is created by the galvanic action of dissimilar metals, and in such case the sacrificial anode is electrically connected to the pipe to complete the galvanic circuit. However the type of metal used for such sacrificial anodes is significantly different. Aluminum, Magnesium, Zinc, and alloys thereof are commonly employed for such purposes. A particularly useful alloy for forming sacrificial anodes is disclosed in the copending application of Michael Tighe et al. entitled Cathodic Protection Anode and Method For Steel Reinforced Concrete, application Ser. No. 09/050,727 filed Mar. 30, 1998. In such copending application there is described several alloys which may be flame sprayed and which may comprise about 10 to about 50 percent zinc, up to about 9.6 percent indium, with the balance being aluminum. Such alloys make excellent sacrificial cathodic protection anodes where concrete is the electrolyte.

Figure 9:
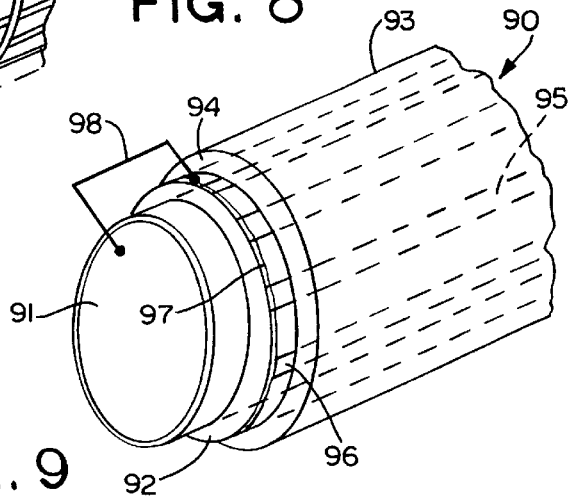
FIG. 9 is a view similar to FIG. 6 but illustrating a sacrificial anode system embedded in the concrete electrolyte and electrically connected to the metal pipe.

In FIG. 9 there is illustrated a composite sacrificial anode pipe section shown generally at 90 which comprises the metal pipe 91, and inner section of electrolyte 92, and an outer section of an electrolyte 93 which stops at shoulder 94.

Between the inner and outer sections of electrolyte there are provided longitudinal strips 95 of such sacrificial anode alloy. The strips may be sprayed on the inner section of the electrolyte by flame spraying and extend axially of the composite pipe section. The strips are generally uniformly spaced circumferentially and at each end the strips are exposed as indicated at 96. The strips are electrically interconnected by a bus ring 97 of the same material and each bus ring is electrically connected at 98 to the metal pipe, completing the galvanic circuit. The pipe sections are joined in the same manner seen in FIG. 4 and the effectiveness of the sacrificial anode system may be monitored in essentially the same manner as in FIG. 5.

Figure 10:
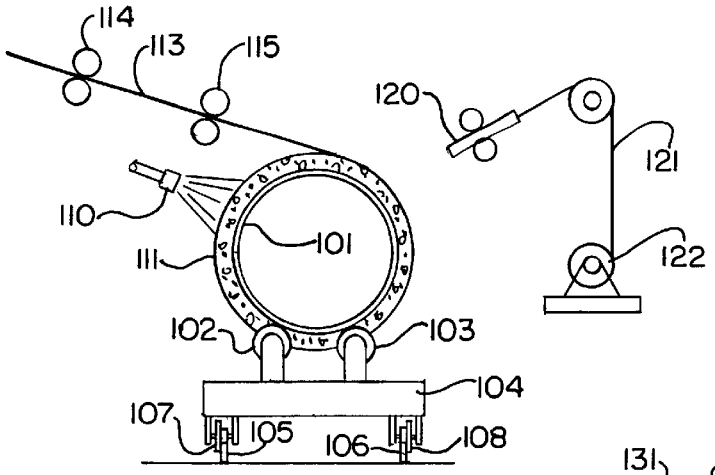
FIG. 10 is a schematic illustration of one form of making the composite pipe sections of the present invention.

There are a number of ways the composite pipe sections of the present invention can be made. In FIG. 10 there is illustrated a process where the metal pipe section indicated at 101 is supported at each end on roller nests 102 and 103, at least one of which rollers is powered for rotation. The rollers are supported on trolley 104 which is supported on rails 105 and 106 by wheels 107 and 108, respectively. In this maner the pipe section is supported at each end for both rotation about its axis and for movement longitudily of its axis. The pipe section movement may be programed to traverse the pipe by a nozzle or applicator 110 which applies the inner electrolyte coating 111 in a uniform fashion. After the inner coating is formed, the anode shown generally at 113 is spooled onto the inner section of the electrolyte to form a continuous cylinder concentric with the pipe section. Once the concentric cylinder is formed the anode material is cut, and the supports for the pipe section ends then program the pipe section both to rotate and move axially so that the applicator 110 will form the uniform outer section of the electrolyte. Suitable removable templates may be employed to form the ends of the inner and outer sections of the electrolyte. When the outer section is completed, the templates may be removed to expose the anode ends and the bus rings are then applied.

Instead of spooling on the valve metal impressed current anode 113 as seen in FIG. 10, the outer surface of the inner section of the electrolyte may be sprayed with the sacrificial anode alloy material as indicated by the flame spray nozzle 120 with the alloy being fed to the nozzle by wire 121 from spool 122. The apparatus of FIG. 10 can thus also form the sacrificial anode of FIG. 9. Once the sacrificial anode strips are in place, the outer section of the electrolyte is placed thereover. The anode strips are then connected by the bus ring 97.

Figure 11:
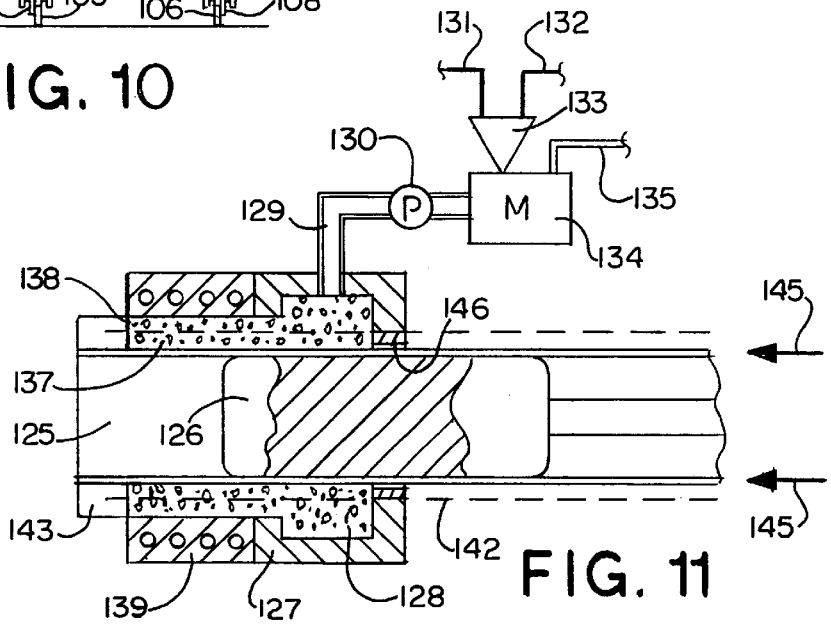
FIG. 11 is a schematic Illustration of another form of making the composite pipe section.

In FIG. 11 there is illustrated an extrusion process wherein the metal pipe section 125 moves axially over a pilot 126 and through an extrusion die 127. The extrusion die includes a concrete plenum or chamber 128 which is supplied with concrete under pressure by line 129 from pump 130. The fine sand and Portland cement mixture enters through the supply lines 131 and 132, respectively, to be funneled at 133 into mixer 134. The appropriate amount of water or other additives is added at 135. The movement of the pipe together with the pressure of the pump 130 causes the inner and outer sections 137 and 138 of the electrolyte to be formed concurrently. The electrolyte may be drawn through a heating collar indicated at 139 to accelerate the cure of the electrolyte.

The anode shown generally at 142 is supported by removable fixture 143 which is mounted on the end of the pipe section. The anode is drawn with the pipe section as it moves in the direction of the arrows 145, and as it is encased by the extruded concrete. The anode may be drawn over a smooth seal indicated at 146 supported from the right hand end of the extrusion apparatus as illustrated. The opposite end of the anode may be supported on a similar fixture or template as that shown at 143.

Figure 12:
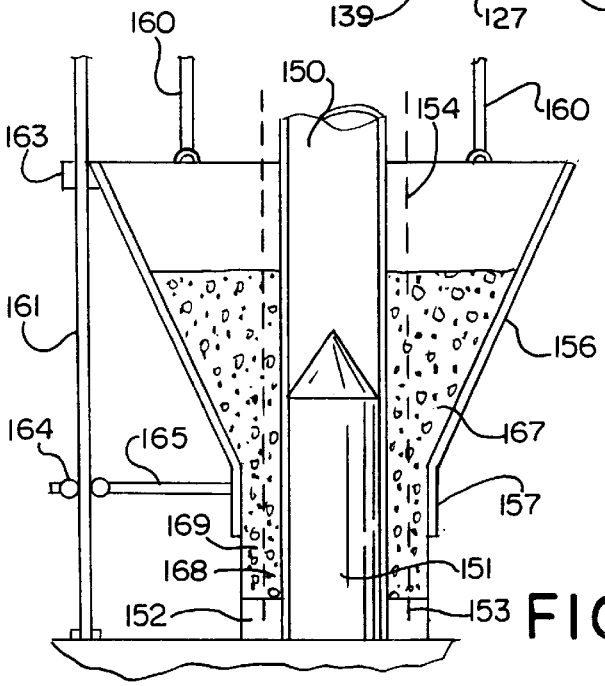
FIG. 12 is a schematic illustration of a still further form of making an anode composite pipe section in accordance with the invention.

FIG. 12 illustrates a manufacturing process for a composite pipe section where the metal pipe 150 is positioned vertically on a pilot 151. A removable template fixture 152 is provided at the bottom of the apparatus and includes a slot 153 in which is seated the end of the tubular anode 154. A conical funnel indicated at 156 includes a cylindrical spout 157 which telescopes over the template or fixture 152. The funnel is supported as indicated at 160 for elevation or vertical movement and is guided vertically by rail 161 which extends parallel to the axis of the pipe. The rail may extend both through a guide sleeve 163 at the top of the funnel as well as the roller set 164 connected to bracket arm 165 extending from the cylindrical spout 157 of the funnel. In its lowermost position the funnel is filled with sufficient electrolyte material such as a Portland cement and sand, or concrete mixture 167, and is then slowly elevated to form concurrently the inner and outer sections 168 and 169 of the electrolyte casing embedding the anode. When the casing is completed, the pipe section is removed. The removal of the templates at the top and bottom then expose the anode ends. The bus rings are then applied and the composite pipe section is completed.

It can now be seen that there is provided a composite pipe section which can be utilized to provide cathodic protection for pipelines where cathodic protection might otherwise be impossible. Not only does the composite pipe section facilitate the installation of the cathodic protection system, whether an impressed current or sacrificial system, but the composite pipe section also protects the pipeline, and in situations where required, the weight of the electrolyte, and particularly the outer section thereof, can be designed to overcome any buoyancy problems which might be encountered in the installation of the pipeline.

To the accomplishment of the foregoing and related ends, the invention then comprises the features particularly pointed out in the claims, these being indicative, however, of but a few of the various ways in which the principles of the invention may be employed.

What is claimed is:

1. A method of forming a composite anode and metal pipe section comprising the steps of applying electrolyte initially to the exterior of a pipe section to form a substantially uniform cover, covering the electrolyte with a grid anode to form a tubular anode substantially concentric but yet spaced from the pipe section, and applying further electrolyte to the anode to embed the anode in the electrolyte.

2. A method as set forth in claim 1 wherein said anode is an expanded valve metal mesh anode.

3. A method as set forth in claim 1 wherein said anode is a valve metal wire grid.

4. A method as set forth in claim 1 wherein said anode is a valve metal ribbon grid.

5. A method as set forth in claim 1 including the step of exposing each end of the metal pipe section to facilitate the joining of sections to form a pipeline, and the step of exposing each end of the anode to facilitate the electrical joining of anodes of adjacent pipe sections.

6. A method as set forth in claim 5 including the step of supplying power to said connected anodes to protect said pipeline with an impressed current.

7. A method as set forth in claim 1 wherein said anode in a sacrificial anode, and electrically connecting such anode to the metal pipe section.

8. A method as set forth in claim 7 wherein said anode is an aluminum-zinc-indium alloy.

9. A method as set forth in claim 8 wherein said anode is in the form of a pattern sprayed on the initial application of electrolyte.

10. A method of making a pipeline having cathodic protection comprising the steps of encircling concentrically a section of metal pipe with a reticulate anode substantially evenly radially spaced from the outer surface of the metal pipe, and encasing the anode in a hardenable electrolytic material to fix the anode spacing from the outer surface of the section of metal pipe substantially uniformly of its length, and then connecting the pipe sections to form a cathodically protected pipeline.

11. A method as set forth in claim 10 wherein the anode of each pipe section is a sacrificial anode electrically connected to the metal pipe.

12. A method as set forth in claim 10 wherein each anode is an impressed current anode, and said anodes are electrically connected to each other and a source of power, but not directly to the metal pipe.

13. A method as set forth in claim 12 wherein said anodes are connected to a parallel bus, and said bus is connected to a source of power.

14. A method as set forth in claim 12 wherein each anode is constructed of a uniform grid of valve metal with an electrochemically active coating.

15. A method as set forth in claim 14 wherein said anode is an expanded mesh.

16. A method as set forth in claim 15 wherein said electrolyte is hardened mixture of Portland cement and sand.

17. A method as set forth in claim 10 including the step of electrically connecting each anode along the pipeline by at least one shorting bar at the pipe section joint.

18. A method of cathodically protecting a pipeline comprising the steps of:

A. encasing pipe sections in an electrolyte having a tubular mesh anode embedded therein and substantially concentric but yet spaced from the pipe section, the ends of each pipe section being exposed; and B. joining the pipe sections at the exposed ends to form a pipeline; and then C. using such anodes cathodically to protect such pipeline.

19. A method as set forth in claim 18 including the step of electrically connecting each anode directly or indirectly to the pipe so that such anodes act as sacrificial anodes.

20. A method as set forth in claim 18 including the step of connecting each anode directly or indirectly to a power source to impress a current through the electrolyte to the pipe so that such anodes act as impressed current anodes.

21. A method as set forth in claim 18 including the step of forming a continuation of the electrolyte over the exposed ends at the pipe joints to provide a continuum of the electrolyte along the pipeline.

22. A metal pipe section composite for forming cathodically protected pipelines comprising a metal pipe section having exposed axial ends, an electrolyte coating extending almost to the ends of said pipe, said electrolyte coating having an inner section and an outer section, and an anode between said inner and outer sections of electrolyte coating generally concentric with said metal pipe section.

23. A pipe section composite as set forth in claim 22 wherein said anode extends axially beyond said inner and outer electrolyte sections to expose said anode at each axial end of said pipe section composite.

24. A pipe section composite as set forth in claim 23 wherein said anode is in the form of a cylindrical grid, and an exposed bus ring connected to said anode at each end.

25. A pipe section as set forth in claim 24 wherein said anode is formed of coated valve metal.

26. A pipe section as set forth in claim 25 wherein said anode is an expanded mesh.

27. A pipe section as set forth in claim 25 wherein said anode is a grid of valve metal ribbons.

28. A pipe section as set forth in claim 25 wherein said anode is a grid of valve metal wires.

29. A pipe section as set forth in claim 25 wherein said anode is a sacrificial anode and is formed of an aluminum-zinc alloy.

30. A pipe section as set forth in claim 25 wherein said electrolyte is concrete.

31. A method of forming a composite pipe anode comprising the steps of applying a hardenable electrolyte coating to the exterior of the pipe completely covering the pipe except for a short distance at each opposite end, placing and embedding an anode in the coating to form a pipe segment having an electrolyte coating with an anode encased therein.

32. A method as set forth in claim 31 wherein said anode is an open grid so that said electrolyte coating is a continuum on each radial side of the anode.

33. A method as set forth in claim 32 wherein said composite pipe section is formed vertically with a hardenable electrolyte flowing through an annular nozzle drawn vertically over a pipe section.

34. A method as set forth in claim 32 wherein said pipe section is supported at each axial end for axial rotation as the electrolyte is applied to the pipe section.

35. A method as set forth in claim 34 including the step of moving the pipe section axially as the electrolyte is applied.

36. A method as set forth in claim 34 wherein the anode is spooled onto the electrolyte as the pipe section is rotated.

37. A method as set forth in claim 32 wherein the electrolyte is formed on said pipe section by extrusion.

38. A method as set forth in claim 32 wherein said anode is formed on said electrolyte by spraying after a first layer of electrolyte has been applied.

39. A method as set forth in claim 38 wherein said anode is a sacrificial anode alloy and is deposited on said electrolyte by flame spraying.

40. A method as set forth in claim 32 wherein said electrolyte is as mixture of Portland cement and sand.

41. A method as set forth in claim 31 including the step of forming the electrolyte as inner and outer sections, with the anode extending axially beyond the inner and outer sections exposing the anode at each axial end of the section.

* * * * *